US005795201A

United States Patent [19]

Tibbetts

[11] Patent Number: 5,795,201

[45] Date of Patent: Aug. 18, 1998

[54] ONE-HANDED CANOE PADDLE

[76] Inventor: John A. Tibbetts, P.O. Box 284, Thomaston, Me. 04861

[21] Appl. No.: 847,150

[22] Filed: Apr. 21, 1997

[51] Int. Cl.[6] ..... B63H 16/04

[52] U.S. Cl. ..... 440/101; 441/56; 416/63

[58] Field of Search ..... 416/63, 72, 74; 440/101; 441/55, 56, 59

[56] References Cited

U.S. PATENT DOCUMENTS

| | | | |
|---|---|---|---|
| 3,039,120 | 6/1962 | Powell | 441/56 |
| 3,518,024 | 6/1970 | Wilson | 416/63 |
| 4,233,925 | 11/1980 | Proctor | 441/56 |
| 4,493,663 | 1/1985 | Richmond | 441/59 |

*Primary Examiner*—Stephen Avila

[57] ABSTRACT

This one-handed canoe paddle is comprised of a blade portion, a hand grip portion, and an arm cuff portion. The hand grip is integral with the blade and is at an angle to the centerline of the paddle approximating the angle which a closed hand makes with the centerline of the forearm when the hand and forearm are in alignment. The arm cuff is U-shaped, positioned perpendicular to the plane of the paddle, and connected to the paddle by a shaft that is of a piece with the blade portion and offset of the centerline of the paddle. The angled hand grip being integral with the blade, the connecting shaft being offset, and the uniquely positioned arm cuff taken together create an aggregate design which:

permits quick, easy access to the paddle;

lets the paddle be picked up and used with one hand;

provides the leverage necessary to propel the canoe in any direction without changing grip position;

allows the wrist to be held in a neutral position during use of the paddle; and produces an esthetically pleasing unit.

2 Claims, 3 Drawing Sheets

ONE-HANDED CANOE PADDLE

CROSS-REFERENCE TO RELATED APPLICATIONS:

| | | |
|---|---|---|
| 2,188,343 | Flournoy | Jan. 30, 1940 |
| 3,039,120 | L. Powell ET AL | June 19, 1962 |
| 3,109,184 | H. E. Moore, Jr. | Nov. 5, 1963 |
| 3,117,325 | J. O. Shelton | Jan. 14, 1964 |
| 3,153,797 | R. B. Drennen, Jr. | Oct. 27, 1964 |
| 3,518,024 | P. M. Wilson | June 30, 1970 |

BACKGROUND OF THE INVENTION

My invention relates to one-handed paddles, specifically, to a one-handed canoe paddle that is convenient and comfortable to use and is not attached to the arm.

Fishing from a canoe requires the fisherman to frequently maneuver the canoe into a more advantageous position. Doing so with traditional paddles requires the use of both hands; the fisherman must set down the fishing equipment, breaking concentration in so doing. Some existing single-hand paddles, designed to hang from the arm when not in use, require the user to insert a hand or forearm through holes or mechanical devices. I find this restrictive, cumbersome, and inhibiting to the fishing experience.

The primary objective of my invention is to make it possible for a fisherman to make subtle adjustments to the position or direction of the canoe without having to set down fishing equipment, as is necessary to operate a conventional paddle.

Another objective of my invention is to provide a means to efficiently propel the canoe with one hand while continuing to use fishing equipment with the other hand.

Another objective is to provide a paddle grip at such an angle that it minimizes strain to the wrist and elbow joints, and is thus comfortable for extended use.

Another objective is to provide a paddle which can be picked up, used and replaced using only one hand. This procedure needs to be a simple, natural movement so as not to detract from the fisherman's primary activity, which is fishing.

Another objective is to provide an arm brace, or cuff, which meets the above mentioned objective, and provides the leverage necessary to propel the canoe in both the forward and backward directions without the need to reposition the hand, grip or arm.

The final objective of my invention is to provide users other than fishermen, such as wildlife photographers, bird watchers and other naturalists, a means of using their canoe to more closely approach wildlife. Propelling a canoe with a conventional paddle requires a significant amount of upper body movement which alarms wary species. Use of my invention to paddle a canoe permits movement in all directions with minimal distracting motion.

BRIEF SUMMARY OF THE INVENTION

The invention comprises a one-handed canoe paddle having a blade portion with integral hand grip and an arm brace, or cuff portion. The cuff is connected to the blade and hand grip by means of an offset connecting shaft. The cuff is U-shaped and oriented perpendicular to the centerline of the blade, with its opening facing toward the same side as the blade. This configuration allows quick, easy access to the paddle and provides sufficient leverage for paddling in both forward and backward directions without the need to shift hand or arm positions. The handle portion is angled to approximate the natural angle of a closed hand with the arm's centerline when the hand is in alignment with the forearm.

The rear elevation is a mirror image of this view.

Figure 4:
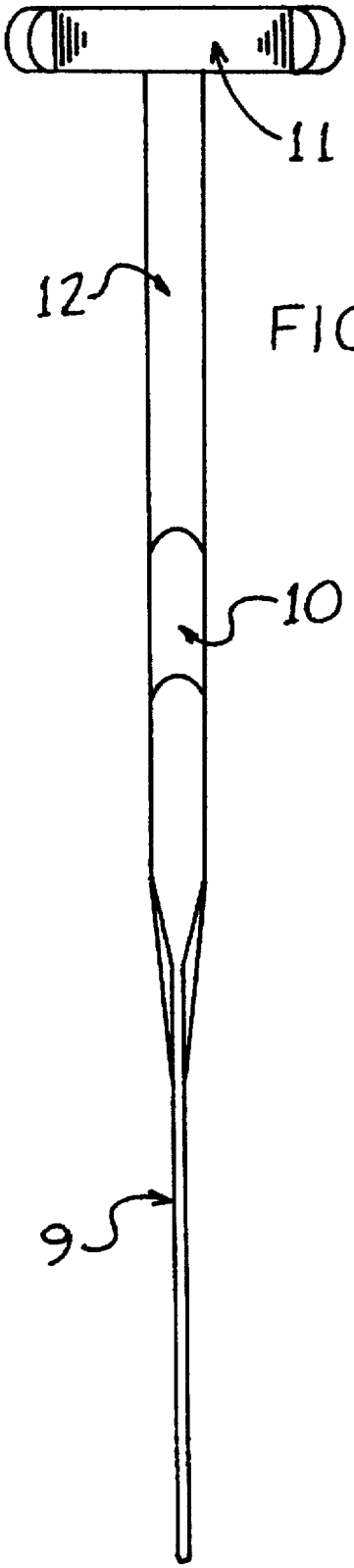

FIG. 4 is the right side elevation view, showing the open face of the cuff 11.

Figure 5:
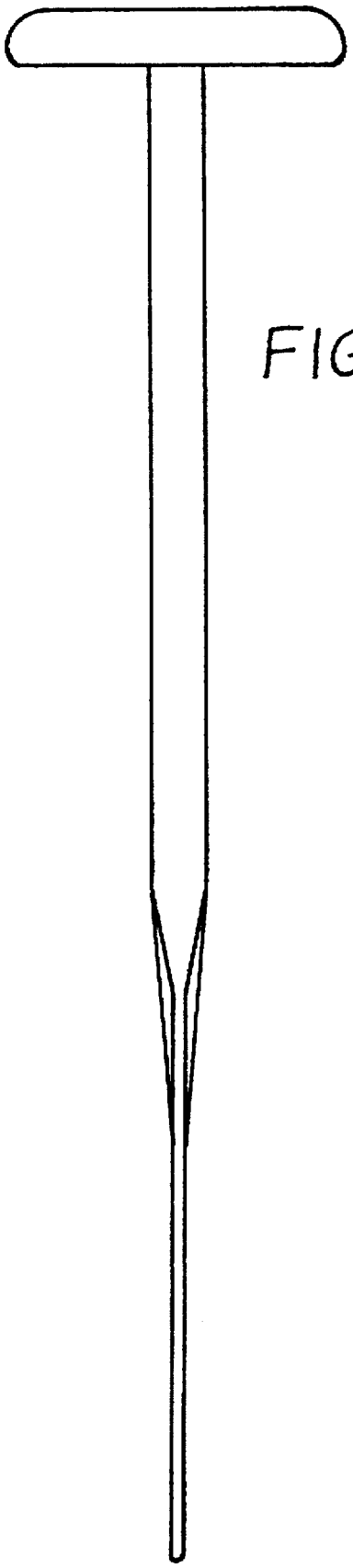

FIG. 5 is the left side elevation view showing the back of the cuff 11.

Figure 6:
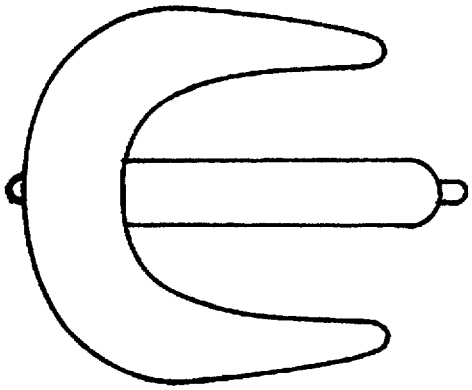

FIG. 6 is the top view of the invention.

Figure 7:
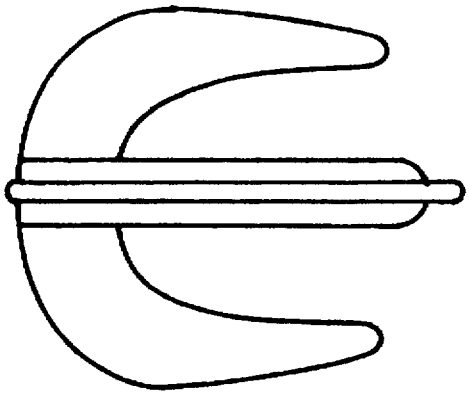

FIG. 7 is the bottom view of the invention.

Figure 8:
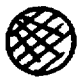

FIG. 8 shows a cross-section of the connecting shaft 12.

DETAILED DESCRIPTION OF THE INVENTION

Figure 1:
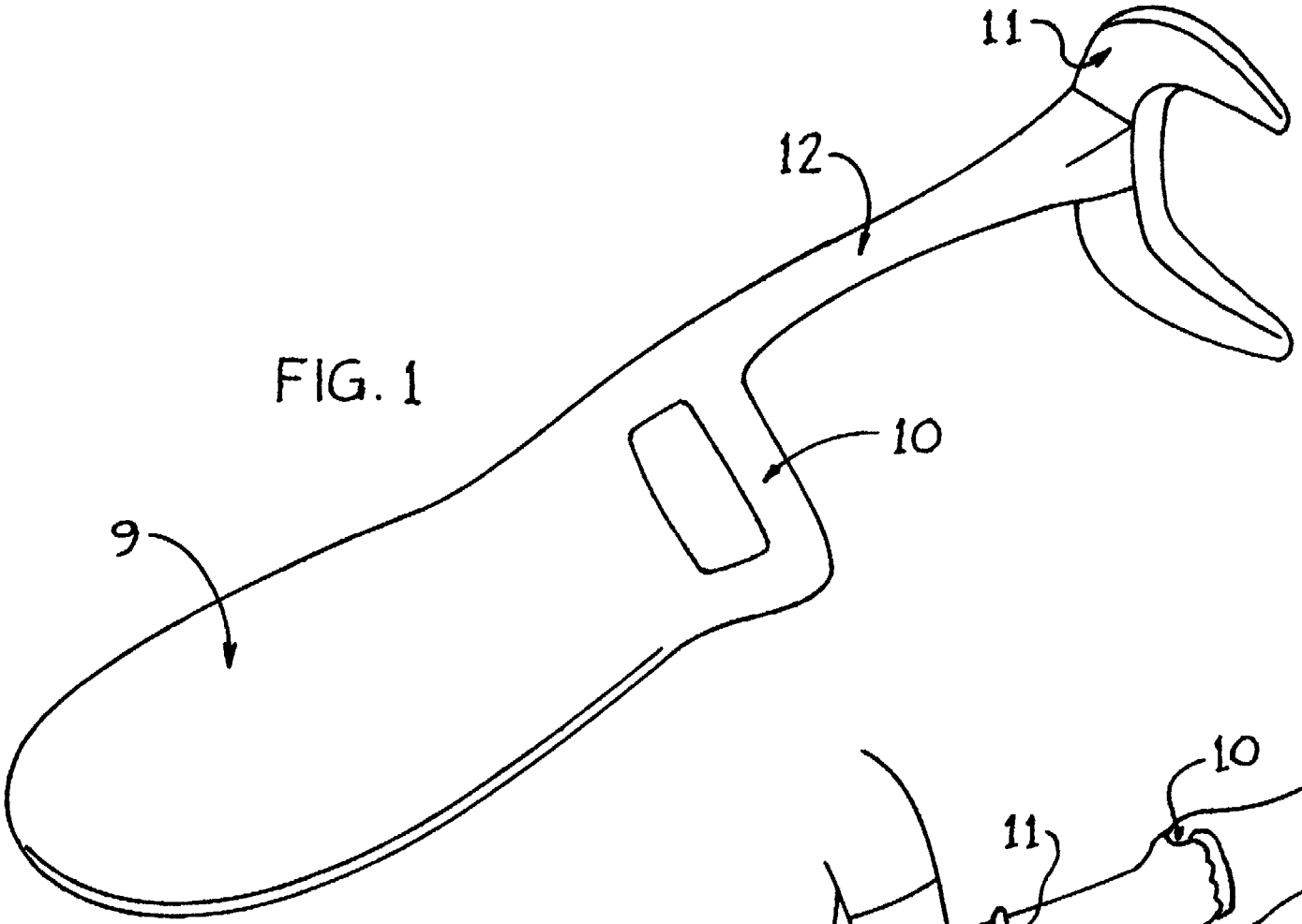
FIG. 1 is an isometric view of the invention.

The design of my one-handed canoe paddle, shown in FIG. 1, is an improvement over earlier designs in that it permits the canoeist to comfortably hold and use the paddle with one hand, unencumbered by mechanical means of attachment.

Figure 2:
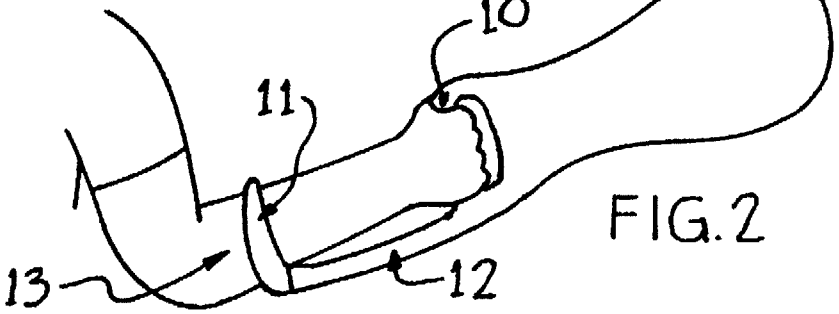
FIG. 2 is a rendering at a smaller scale, showing how the paddle is gripped.

Referring to FIG. 2, the paddle is held with the connecting shaft 12 along the lateral (little finger) side of the arm and the cuff 11 opening toward the medial (thumb) side. This design uses principles of leverage and resistance so that no mechanical attachments, e.g., straps, hooks, etc., are required to hold the invention in position. Grasping the hand grip 10 stabilizes the cuff 11 against the forearm 13. The cuff 11 provides the leverage needed to paddle with one hand. The orientation of the cuff opening and the offset design of the shaft allow quick, unencumbered access.

Figure 3:
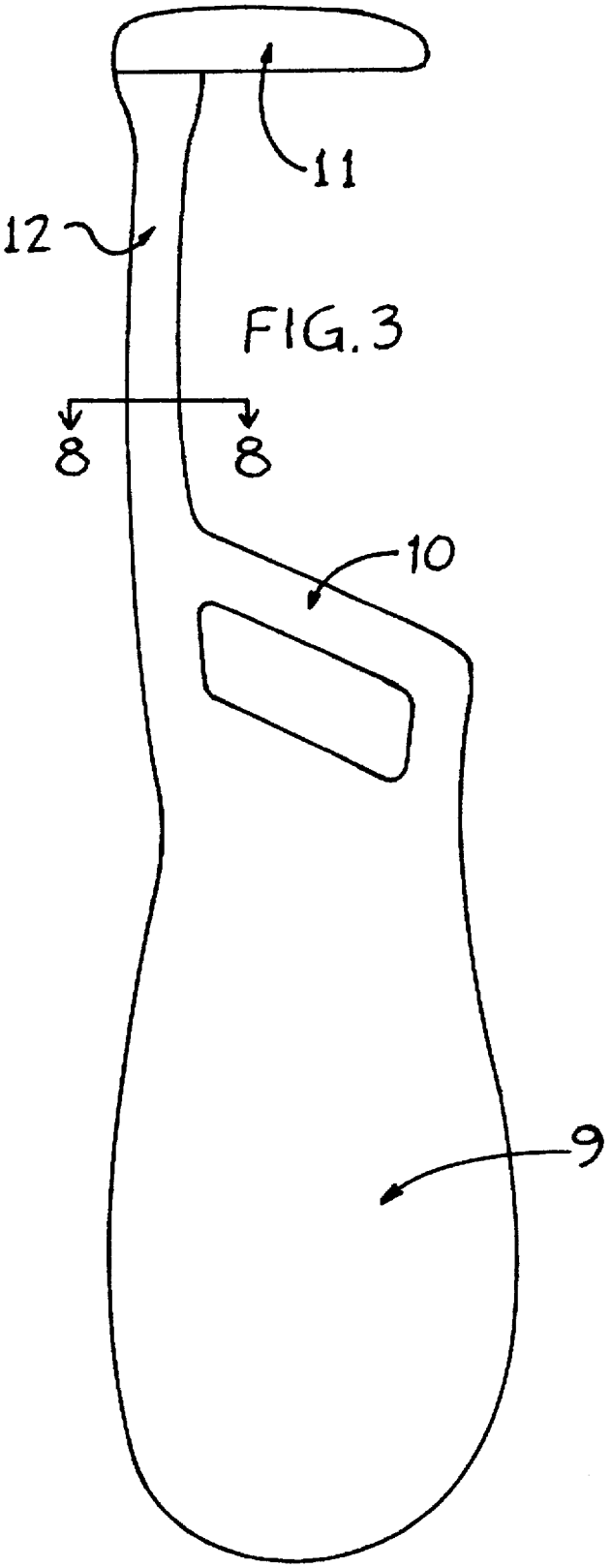
FIG. 3 is a front elevation view of the invention showing: the paddle blade 9, the angled handle 10, the side of the cuff 11, and the offset connecting shaft 12.

Referring to FIG. 3 and FIG. 4 the blade 9, handle 10 and cuff 11, are on the same centerline. The design of the hand grip 10 differs from old designs in that the grip is angled to keep the wrist in a neutral position. The angle approximates the natural angle that a closed hand makes with the arm's centerline when in alignment with the forearm. The offset design of the connecting shaft 12 allows the user's forearm and wrist to remain in alignment with the blade 9 when the paddle is held at the hand grip 10.

The preferred material for the construction of this invention is wood, due to its availability and workability. Other materials, such as metal or synthetic materials, are also possible, with the only criteria being that they are of sufficient strength to withstand the stresses induced by paddling and that they be buoyant in water so that the paddle will float if accidentally dropped overboard.

When constructed from wood, the blade 9, hand grip 10 and connecting shaft 12 are constructed as a single unit. The cuff 11 is constructed separately and connected to the end of the shaft 12 using common joinery techniques and waterproof, permanent adhesive. All surfaces are smoothed and sealed to protect the paddle from the elements.

Overall, the design, construction, and finishing of this one-handed canoe paddle provides for an esthetic appearance.

What I claim as my invention is:

1. A one-handed canoe paddle comprising a blade portion, an angled hand grip portion, and an arm cuff portion, said blade and arm cuff portions being connected by means of a shaft constructed in the same plane as, and of a single unit with, the blade and hand grip, but being offset to the centerline of the blade and hand grip a distance equal to approximately one-half the thickness of an adult arm;

said arm cuff being U-shaped, positioned perpendicularly to the plane of the blade and hand grip, attached at the base of the U to the shaft opposite the blade, with the arms of the U being parallel to and above the hand grip, said hand grip being constructed in the same plane as, and of a single unit with, the blade portion and at an angle approximating the natural angle that a closed hand makes with the centerline of the arm when the hand is in alignment with the forearm.

2. A one-handed canoe paddle according to claim 1 wherein the paddle is particularly detailed with attention to curves, edges, and surface finish to produce an esthetically pleasing unit.

* * * * *